US006867404B2

(12) United States Patent
Lee et al.

(10) Patent No.: US 6,867,404 B2
(45) Date of Patent: Mar. 15, 2005

(54) MICROWAVE SEALING STRUCTURE AND MICROWAVE OVEN HAVING THE SAME

(75) Inventors: Young-Min Lee, Incheon (KR); Yang-Kyeong Kim, Gunpo (KR); Jong-Kwan Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 174 days.

(21) Appl. No.: 10/207,985

(22) Filed: Jul. 31, 2002

(65) Prior Publication Data

US 2003/0141298 A1 Jul. 31, 2003

(30) Foreign Application Priority Data

Jan. 30, 2002 (KR) ..... 2002-5462

(51) Int. Cl.[7] ..... H05B 6/76
(52) U.S. Cl. ..... 219/741; 219/742; 174/35 GC
(58) Field of Search ..... 219/738–744; 174/35 MS, 35 R, 35 GC

(56) References Cited

U.S. PATENT DOCUMENTS 3,597,566 A * 8/1971 Johnson et al. ..... 219/696
4,584,447 A 4/1986 Kusunoki et al. ..... 219/10.55
4,645,892 A 2/1987 Gustafsson ..... 219/10.55
4,659,891 A 4/1987 Yamaguchi et al. ..... 219/10.55
4,742,201 A 5/1988 Nakano et al. ..... 219/10.55
5,036,171 A * 7/1991 Kim et al. ..... 219/742
5,206,478 A * 4/1993 Lee ..... 219/742
5,705,797 A * 1/1998 Seo ..... 219/742
5,861,612 A * 1/1999 Brodsky et al. ..... 219/738

OTHER PUBLICATIONS

S. Ohkava, H. Watanave and K. Kane, "High Resonance Door Seal for Microwave Oven" (Microwave Power Symposium Digest, 1978).

* cited by examiner

*Primary Examiner*—Philip H. Leung
(74) *Attorney, Agent, or Firm*—Fleshner & Kim, LLP

(57) ABSTRACT

A microwave sealing structure prevents leakage of microwave to the outside of the cavity in which microwave resonates, in an apparatus using microwave which includes a cavity in which an internal space is formed so that microwave can resonate having an opening, and a door for opening/closing the opening. In the structure, an equivalent impedance circuit, formed with a rim of the opening and a cross-section of the rim of the door to prevent leakage of microwave out of the cavity, is a LC resonant circuit.

16 Claims, 7 Drawing Sheets

MICROWAVE SEALING STRUCTURE AND MICROWAVE OVEN HAVING THE SAME

BACKGROUND OF THE INVENTION

1. Field of the Invention

The present invention relates to an apparatus using microwave and particularly, to a microwave sealing structure, capable of preventing leakage of microwave to the outside of a cavity where electron wave resonates.

2. Description of the Background Art

FIG. 1 is a perspective view showing a composition of a conventional microwave oven.

Generally, as shown in FIG. 1, a microwave oven includes a microwave energy source (not shown) and a resonator 1. The resonator 1 includes a cavity 2 having an opening 2A and a door 5 which can open and close the opening 2A. When the door 5 is closed, a gap exists between the cavity 2 and a door 5 and this gap basically forms a slot waveguide for leaking microwave energy from the resonator 1.

FIG. 2 is an enlarged cross-sectional view of A portion in FIG. 1 and FIG. 3 is a partial cut-away view showing a rim 5A of a door of the microwave oven of FIG. 1.

To prevent such leakage of microwave energy, microwave ferrite rubber is used for the door 5 of the microwave oven or a microwave sealing choke 7 is mounted around the door 5 or opening 2A as shown in FIGS. 2 and 3. Here, reference numeral 6 designates a choke cover which is non-conductive and covers the choke 7 and reference numeral 2B designates a rim surface of the opening 2A.

The microwave sealing choke is formed by having a distributed parameter choke of quarter wave and efficiently seals fundamental wave that microwave energy is leaked from the resonator of a microwave oven.

There are some examples that sealing of harmonics as well as the fundamental wave are considered. One of the examples is a multi-mode sealing choke disclosed in the U.S. Pat. No. 4,659,891. However, generally, a complicated structure is necessary to cover the harmonics.

As an example of the multi-mode microwave sealing choke for preventing leakage of microwave energy in the slot waveguide which is formed between the door and cavity of the microwave oven, there is a multi-mode microwave sealing choke having composite advantages in designation, which is disclosed in a thesis presented by S. Ohkava, H. Watanave and K. Kane, "High Resonance Door Seal for Microwave Oven" (Microwave Power Symposium Digest, 1978).

The multi-mode microwave sealing choke is installed in the quarter wave choke along a predetermined line that a series of LC circuits which are combined to each other strongly, cross the wave vector of microwave to be sealed and at the same time, a parallel LC circuit is installed in the quarter wave choke.

The two quarter chokes are combined with the slot waveguide through the combining hole. The LC circuits are composed of distributed parameter circuits.

However, the structure of the above composition is very complicated and the size is too large. Mass production is difficult. The direction of the technical development of the door of the microwave oven has been how a door with an improved performance can be miniaturized and embodied with a lower price.

On the other hand, the conventional microwave sealing structure can be described with reference to the U.S. Pat. Nos. 4,584,447, 4,742,201, 4,645,892 and the like.

In the U.S. Pat. No. 4,584,447, it is shown that an impedance inversion can be occurred in a shorter distance than the conventional quarter wave sealing choke. However, with the structure, mass productivity is decreased and has a mechanically frail structure. In terms of the performance, the structure has an excellent characteristic only in a wave incidence angle of a limited extent.

As an improved structure, there is a microwave sealing structure which is disclosed in the U.S. Pat. No. 4,742,201. However, the structure was not changed much but improving the mass productivity and mechanical strength at a certain degree.

The microwave sealing structure which is disclosed in the U.S. Pat. No. 4,645,892 is a structure which substantially improves the mass productivity of the door by making a hole of a screen with a steel plate and die cutting the portion to be bent in advance, differently from the conventional method.

However, the whole size of the structure is increased since the structure requires about half wave distance from the starting point of the gap inside the cavity to a short wall. Also, the structure shows an excellent characteristic only in a wave incidence angle of a limited extent.

On the other hand, the conventional microwave sealing structure for preventing leakage of the microwave energy was a sealing structure with a concept of a choke, that is, a concept for cutting off the transmission line by forming a distributed circuit of a quarter wave in a line of the transmission line.

Therefore, the sealing characteristic of a wide range of wave incidence angle was not good and to improve the performance, the structure became complicated.

Also, there was a limit for designing the microwave sealing structure small since the size of the choke is related to the wavelength of the microwave, that is, the length.

Therefore, in the conventional microwave sealing apparatus of the microwave oven, a proper structure to be commercially applied to a microwave oven is not disclosed and the manufacturing is complicated due to the structure.

SUMMARY OF THE INVENTION

Therefore, an object of the present invention is to provide a microwave sealing structure which has a simple structure and compact size, thus to efficiently seal microwave.

To achieve these and other advantages and in accordance with the purpose of the present invention, as embodied and broadly described herein, there is provided a microwave sealing structure in an apparatus using microwave which includes a cavity in which an internal space is formed so that microwave can resonate having an opening, and a door for opening/closing the opening. In the apparatus, an equivalent impedance circuit, formed with a rim of the opening and a cross-section of the rim of the door to prevent leakage of microwave out of the cavity, is a LC resonant circuit.

Also, the present invention provides a microwave oven which includes the cavity in which the internal space is formed so that microwave can resonate having the opening, and the door for opening/closing the opening. In the microwave oven, the equivalent impedance circuit, formed with the rim of the opening and the cross-section of the rim of the door to prevent leakage of microwave out of the cavity, is the LC resonant circuit.

Also, the present invention provides a microwave oven, comprising the cavity in which the internal space is formed so that microwave can resonate having the opening, and the door for opening/closing the opening. An equivalent circuit, formed with the rim of the opening and the cross-section of the rim of the door to prevent leakage of microwave out-of the cavity, is the LC resonant circuit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 4:
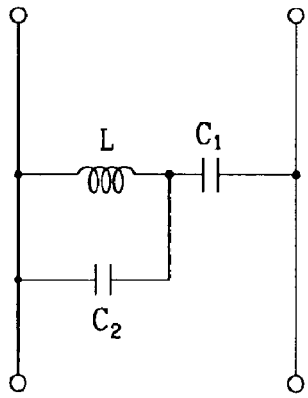
FIG. 4 is an equivalent impedance circuit view of a microwave sealing structure in accordance with the present invention.
Figure 5:
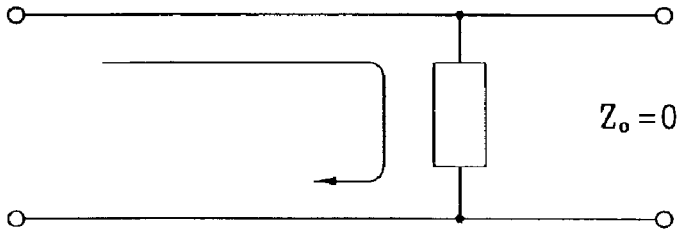
FIG. 5 is a circuit view showing a microwave sealing principle of the microwave sealing structure in accordance with the present invention.
Figure 6:
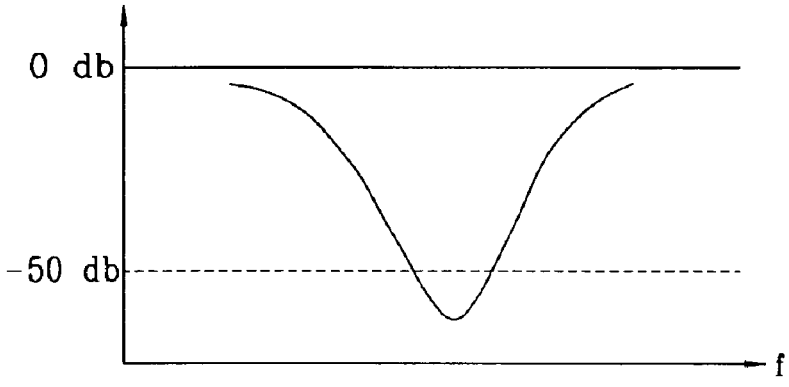
FIG. 6 is a graph showing an attenuation characteristic of the microwave sealing structure in accordance with the present invention.

FIG. 4 is an equivalent impedance circuit view of a microwave sealing structure in accordance with the present invention, FIG. 5 is a circuit view showing a microwave sealing principle of the microwave sealing structure in accordance with the present invention and FIG. 6 is a graph showing an attenuation characteristic of the microwave sealing structure in accordance with the present invention.

Figure 1:
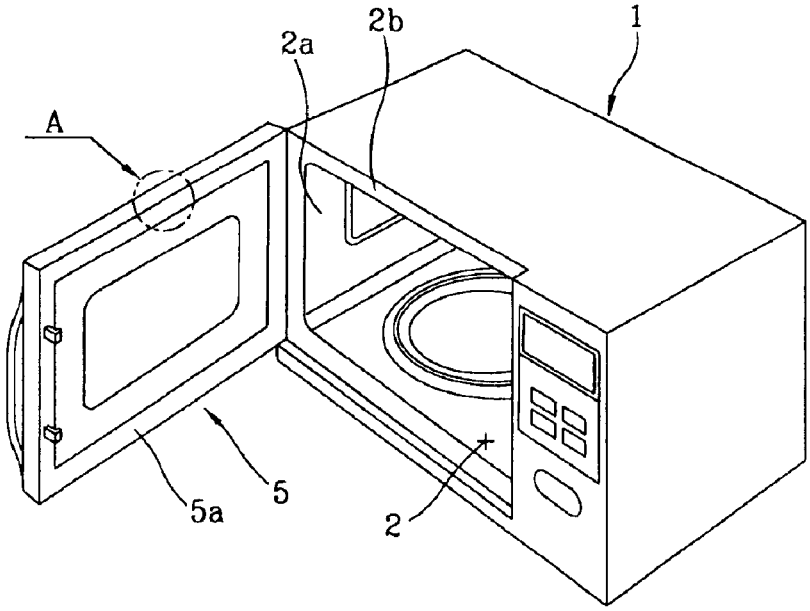
FIG. 1 CONVENTIONAL ART
FIG. 1 is a perspective view showing a composition of a conventional microwave oven.
Figure 2:
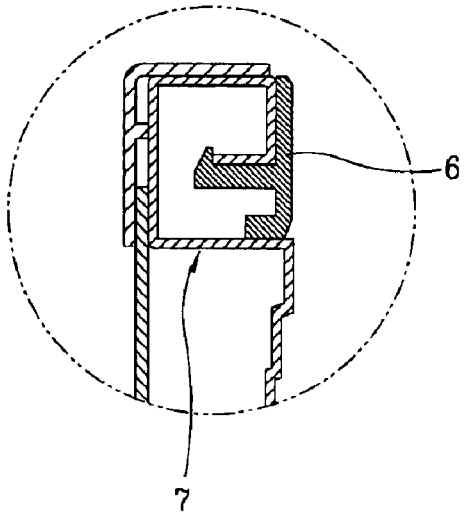
FIG. 2 CONVENTIONAL ART
FIG. 2 is an enlarged cross-sectional view of A portion in FIG. 1.
Figure 3:
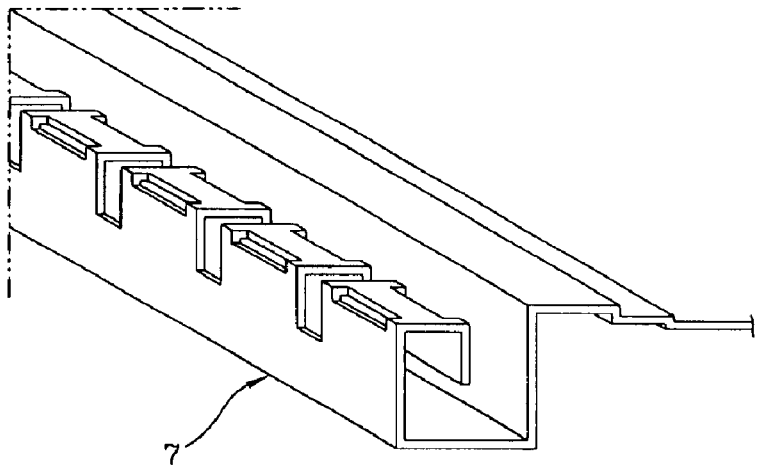
FIG. 3 is a partial cut-away view showing a rim of a door of the microwave oven of FIG. 1.

As shown in FIG. 1, the microwave sealing structure of the apparatus using microwave, such as a microwave oven in accordance with the present invention, includes a cavity 2, in which an internal space is formed so that microwave can resonate having an opening 2A, and a door 5 for opening/closing the opening 2A.

Particularly, in the microwave sealing structure of the present invention, an equivalent impedance circuit, formed with a rim 2B of the opening 2A and the rim 5A of the door 5, is a LC resonant circuit.

The LC resonant circuit can be formed variously and in an embodiment of the LC resonant circuit of the microwave sealing structure in accordance of the present invention, as shown in FIG. 4, the LC resonant circuit includes a first capacitor $C_1$, an inductor L and second capacitor $C_2$ which are connected with the first capacitor $C_1$ and formed in parallel. The reactance value of the LC resonant circuit is 0.

Namely, the reactance X of the impedance Z of the LC resonant circuit has a value of 0 and this can be displayed as Formula 1 as follows.

$$Z=R+jX \qquad \text{Formula 1}$$

Also, when the reactance is 0, the LC resonant circuit is resonated and the resonant frequency $f_0$ is displayed as the following Formula 2.

$$f_0 = \frac{1}{2\pi\sqrt{LC}} \qquad \text{Formula 2}$$

(here, L designates a whole inductance and C designates a whole capacitance)

The microwave sealing structure in accordance with the present invention forms a LC resonant circuit composed of inductance L which is a lumped parameter among transmission lines and a capacitance C, differently from the distributed parameter which is the conventional microwave sealing structure.

As shown in FIG. 5, the transmission line is shorted as $Z \cong 0$ when the reactance X is 0 in such LC resonant circuit, particularly when $R \cong 0$ and accordingly the microwave is projected to the LC resonant circuit and all reflected.

Therefore, the microwave sealing structure in accordance with the present invention is a structure in which the sealing filter shorts a line among the transmission lines and is a structure which is shorted by connecting the transmission lines, differently from the conventional microwave sealing structure composed of dispersed parameter device. Also, the microwave sealing structure in accordance with the present invention has a characteristic as concentrated parameter device and it is experimentally verified that the microwave can be totally reflected.

Particularly, as shown in FIG. 6, the microwave sealing structure in accordance with the present invention structurally varies the interval between the rim 5A of the door and rim surface 2B of the opening 2A which is abutted to the rim 5A of the door, contact area, material of the main body of the door 5 frame and cavity 5, dielectric constant of the cover between the rim 5A of the door and rim surface 2B of the opening 2A and the like or varying the size of the cross-section of the rim 5A of the door 5, by adjusting the inductance L and capacitance C and accordingly can adjust band width to be cut off by varying resonant frequency $f_0$, thus to improve the attenuation characteristic of frequency to be cut off.

On the other hand, the LC resonant circuit which is formed in the microwave sealing structure according to the present invention can be composed in structure.

Figure 7:
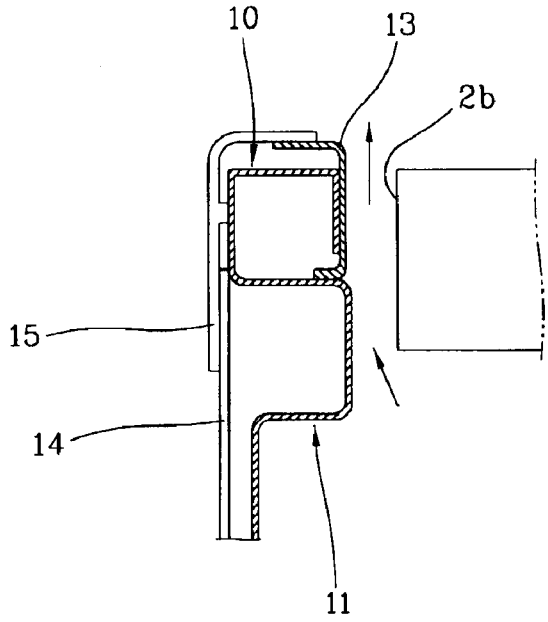
FIG. 7 is a partial cross-sectional view showing an embodiment of the microwave sealing structure in accordance with the present invention.
Figure 8:
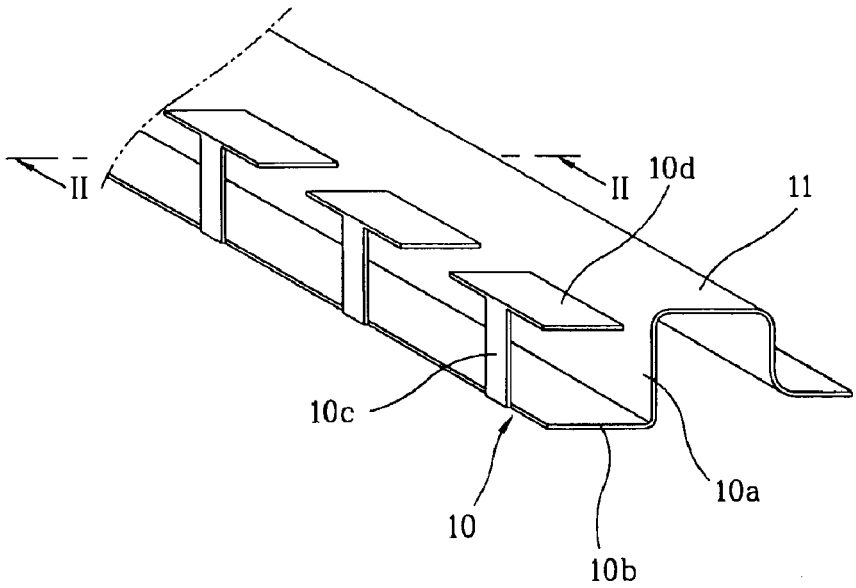
FIG. 8 is a perspective view showing the microwave sealing structure of FIG. 7.
Figure 9:
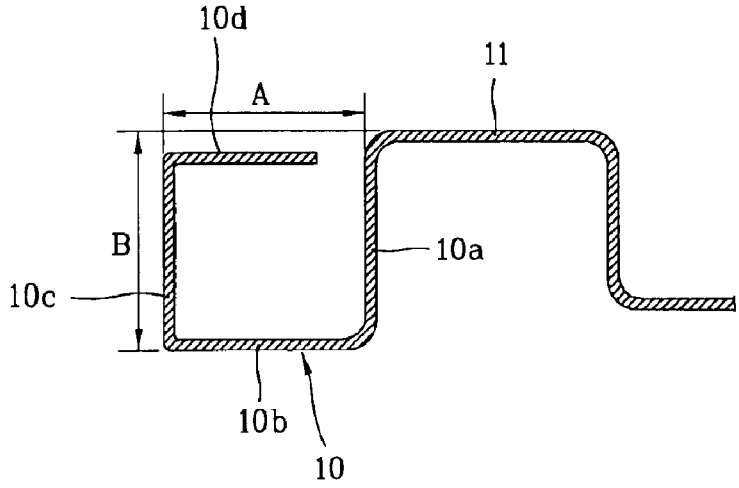
FIG. 9 is a cross-sectional view taken along section line II–II' of the microwave sealing structure of FIG. 8.
Figure 10:
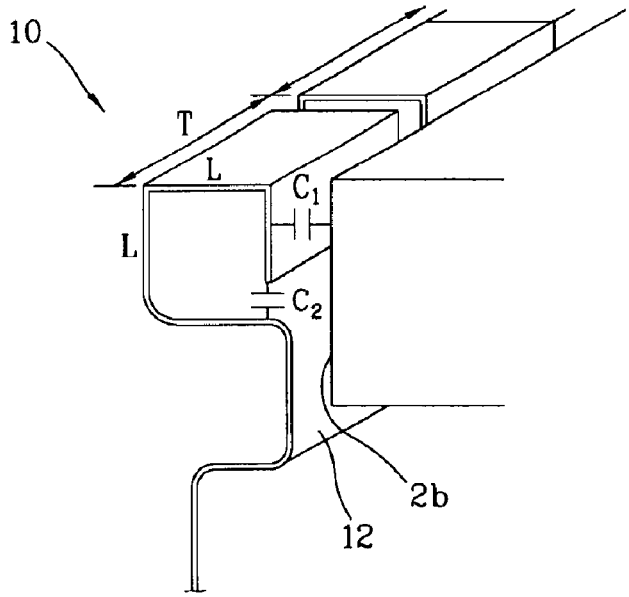
FIG. 10 is a perspective view showing a structure of an equivalent impedance circuit which is formed by the microwave sealing structure of FIG. 7.
Figure 11A:
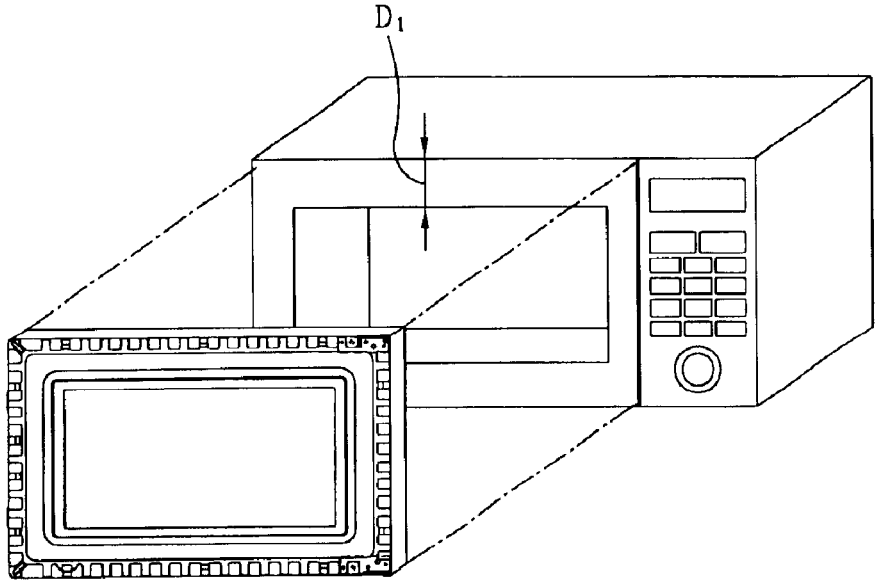
FIGS. 11A and 11B are comparison views which compare a microwave oven having the conventional microwave sealing structure and micro oven having the conventional microwave sealing structure in accordance with the present invention.
Figure 11B:
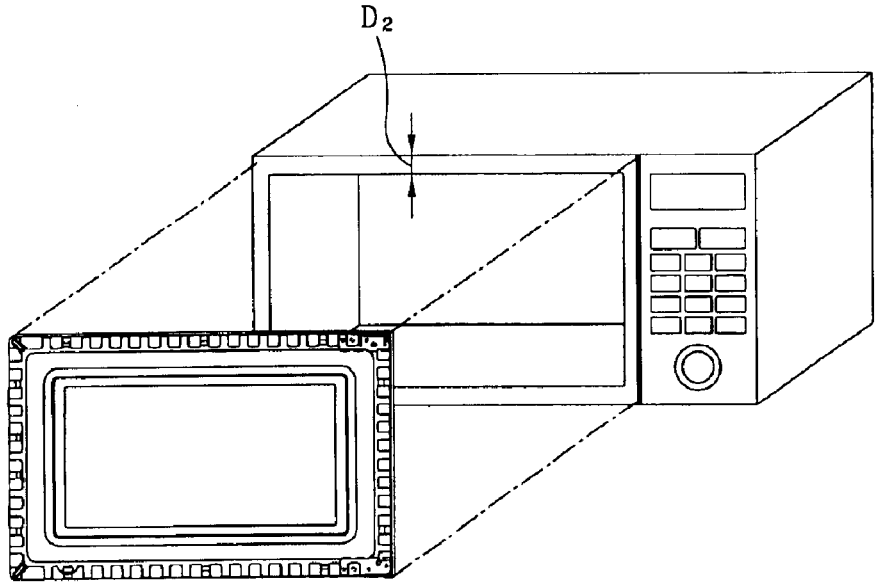

FIG. 8 is a perspective view showing the microwave sealing structure of FIG. 7, FIG. 9 is a cross-sectional view taken along section line II–II' of the microwave sealing structure of FIG. 8, FIG. 10 is a perspective view showing a structure of an equivalent impedance circuit which is formed by the microwave sealing structure of FIG. 7, and FIGS. 11A and 11B are comparison views which compare a microwave oven having the conventional microwave sealing structure and micro oven having the conventional microwave sealing structure in accordance with the present invention.

In the microwave sealing structure in accordance with the present invention, as shown in FIGS. 7 to 10, to compose the above LC resonant circuit, a non-conductive cover portion 13 is combined to the inner circumferential portion of the sealing portion 10 which is integrally formed in the rim 5A of the door and the door panel 15 and screen 14 are combined outwards. The sealing portion 10 includes a LC circuit as a concentrated parameter device among the transmission lines as shown in FIG. 4.

The equivalent impedance circuit formed by the sealing portion 10, opening 10, cavity 2 and the like can be embodied with the LC circuit as a simple structure as shown in FIG. 10. Namely, in such structure which is installed in the slot waveguide, capacitors $C_1$ and $C_2$ are formed between the vented portion and the wall of the slot waveguide and the body portion is operated by the inductance L. Generally, metal itself has an inductance substance and a capacitance is formed between two metal surfaces which face each other.

The sealing portion 10 in accordance with the embodiment of the microwave sealing structure of the present invention is pressed to be a metal plate and formed by bending the door panel portion 11 which is combined to the inside of the door 5 and the sealing portion 10 integrally.

The sealing portion 10 is formed in a square shape integrally and includes a door panel portion 11 which is parallel to the rim surface 2B of the opening 2A, a first sealing portion 10A which is vertical with the rim surface 2B of the opening 2A and connected to the outward direction of the cavity 2, a second sealing portion 10B which is parallel to the rim surface 2B of the opening 2A and connected to the first sealing portion 10A in the outward direction of the cavity 2, a third sealing portion 10C which is parallel to the first sealing portion 10A connected to the second sealing portion 10B in the inward direction of the cavity 2 and a fourth sealing portion 10D which is parallel to the second sealing portion 10B connected to the third sealing portion 10C, facing the first sealing portion 10A.

The end of the fourth sealing portion 10D is formed to maintain a predetermined interval with the upper end portion of the door panel portion 11 and the fourth sealing portion 10D is formed as a square screen.

Also, it is desirable that a plurality of slots 13 are repeatedly formed by the press processing along the longitudinal direction of the rim of the door so that the square plate shapes of the fourth sealing portion are continuously at a predetermined slot distance T, to increase the microwave sealing effect.

When the distance between the upper end portion of the fourth sealing portion 10D and the door panel portion 12 is A, and the width of the third sealing portion 10C is B, it is desirable that the A is 19.0 mm or shorter, B is 18.0 mm or shorter and the slot distance at the fourth sealing portion is 20.0 mm or shorter, by taking the wave of the microwave used in the conventional microwave oven into consideration.

The structure of the sealing portion 10 forms a LC circuit composed of the capacitor and inductance and has a wide attenuation band. The sealing portion 10 is installed at a predetermined position where the LC circuit combined to the slot waveguide crosses the wave vector of the leaked wave.

In the microwave sealing structure of the present invention, a magnetron (not shown) which is a microwave energy resource, makes a field distribution of a very complicated shape in the multi-mode resonator when the opening 2A of the cavity of the apparatus using microwave, such as a microwave oven is closed by the door 5, and a plane wave is projected to the slot waveguide which is formed between the door 5 and the front panel of the cavity 2 at a predetermined angle.

After the plane wave passes the slot waveguide, the plane wave is transmitted to the sealing portion 10 of the microwave sealing structure and excites the slot waveguide. At this time, the sealing portion 10 seals the projected plane wave and the power transmission coefficient of the incidence wave which is projected being tilted by the LC resonant circuit system which is positioned on the end surface of the slot waveguide is defined by the following Formula 3.

$$T_{pa}^2 = \left(\frac{B_L}{Kd} \cdot \frac{M}{L}\right)^2 \cdot \left(1 - \cos\left\{\frac{kB_L}{K} \cdot \sin\theta\right\}\right)^2 \qquad \text{Formula 3}$$

$T_{pa}$: energy transmission coefficient

M: interactive inductance of LC circuit $B_L$: length of sealing filter of multi-mode L: inductance of LC circuit K: number of LC circuits K: wavelength of microwave d: valid sectional area of LC circuit θ: incidence angle of multi-mode sealing filter According to the above formula, the transmitted power is minimized when the microwave is projected perpendicularly. The transmitted power can be reduced by reducing M (combination of LC circuits) or increasing L of the LC resonant circuit of the number of the resonant circuits K. Therefore, the dependency of the power transmission on the incidence angle by optimizing each parameter of the microwave sealing structure and low transmission coefficient can be obtained for microwave of a wide incidence angle.

The frequency band can be widened by tuning at least a circuit among the combined circuits to near the frequency to be restrained and the condition required for using the sealing filter. The frequency can be attenuated by tuning the LC circuits respectively different systems of the combined circuits to the frequency corresponding to the frequency to be restricted, that is, to the high frequency harmonics of the source.

Here, the first capacitor $C_1$ is a capacitor which is formed between the rim surface 2B of the opening 2A and firstly attenuates microwave projected from the cavity 2.

Namely, as shown in FIG. 5, in the multi-mode filter type microwave sealing structure, the reactance X of the impedance Z becomes "0" and accordingly, it goes under the short state. Therefore microwave cannot be flow further and as shown in FIG. 6, if the X-axis designates frequency and Y-axis designates attenuation amount, angular point at the bottom of the graph becomes 2,456 GHz which is the cut off frequency in the conventional and the most attenuation in the structure in accordance with the present invention is occurred.

In the microwave sealing structure in accordance with the present invention, the width and thickness of the sealing portion can be shorter than the conventional microwave sealing structure. As shown in FIGS. 11A and 11B, the thickness $D_1$ of the cavity of the microwave oven having the conventional microwave sealing structure can be thinner than the thickness $D_2$ and the volume of the internal cavity in the set of the identical external size can be designed larger by reducing the area of the opening rim surface of the contacted cavity.

On the other hand, the microwave sealing structure can be composed under the condition that the equivalent impedance circuit satisfies the LC circuit shown in FIG. 4 besides the embodiment of FIGS. 7 to 10.

Figure 12:
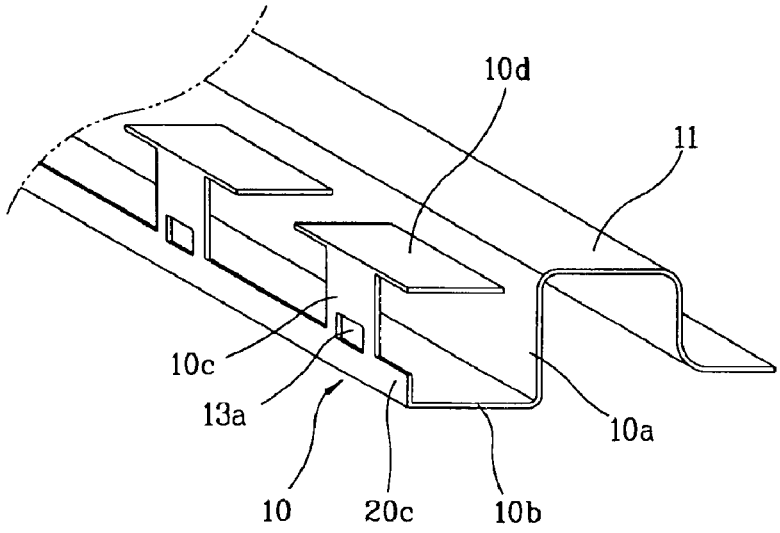
FIGS. 12 and 13 are partial perspective views respectively showing the other embodiments of the microwave sealing structure in accordance with the present invention.
Figure 13:
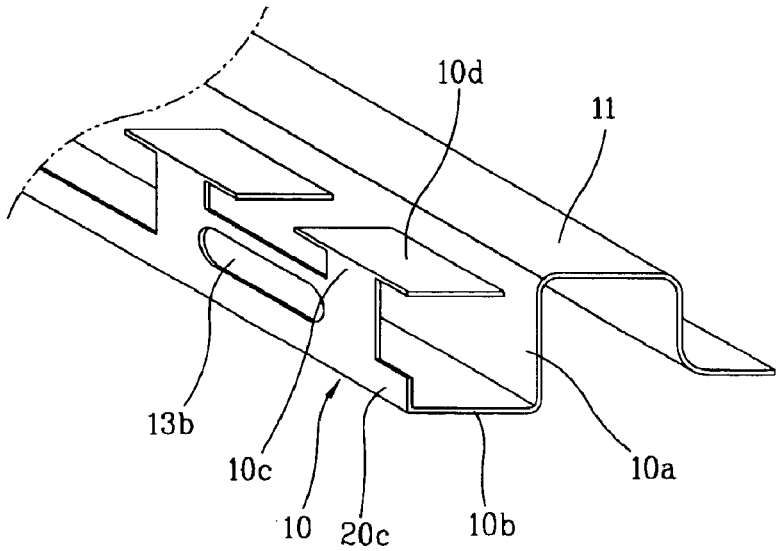

FIGS. 12 and 13 are partial perspective views respectively showing the other embodiments of the microwave sealing structure in accordance with the present invention. That is, the other embodiment of the microwave sealing structure in accordance with the present invention is shown in FIGS. 12 and 13.

The basic structure of the microwave sealing structure in accordance with the present invention is identical as the embodiment of FIG. 7. Since an extension portion 20C which is extended from the second sealing portion 10B is formed in the lower end portion of the third sealing portion 10C forming the sealing portion 10 taking mass productivity into consideration, bending can be easily done. A combining slot 13A to which a latch (not shown) or cover portion 13 is combined is formed in the third sealing portion 10C.

Also, as shown in FIG. 13, the microwave sealing structure in accordance with the present invention is generally identical as the microwave sealing structure shown in FIG. 12 and a combining slot 13B for combining the structure with the latch or cover portion 13 is formed on the extension portion 20C between itself and the third sealing portion 10C.

On the other hand, boundary between the first and second sealing portions 10A and 10B is formed in the shape of a straight or curved line at the rim portion among the rims 5A of the door 5, to increase sealing effect of microwave.

As described above, the microwave sealing structure is installed along the opening of the cavity and partially installed inside the slot waveguide composed of the door and front panel. The arrangement can optimize the parameter of the microwave sealing structure, reduce transmission of microwave with a broad incidence angle and minimize transmission dependency on the incidence angle.

Also, necessary technical effect can be achieved by broaden the extent of the incidence angle which can be sealed.

Also, with the microwave sealing structure in accordance with the present invention, a side wall of the slot waveguide is used as an electrode or the door is used as an electrode of the capacitance of at least one LC circuit, thus to reduce the size of the microwave sealing structure and reduce the whole size of the apparatus.

Also, the microwave sealing structure in accordance with the present invention can have a broad band characteristic and lower the condition required for usage by tuning at least one LC circuit among a plurality of LC circuits to the vicinity of the frequency to be sealed.

Particularly, the size of the conventional microwave sealing structure is limited according to the size of the wave, but the microwave sealing structure in accordance with the present invention can optimize respective parameters of the LC circuit and reduce the width and thickness of the microwave sealing structure, thus to have a thin thickness of the door. In addition, a large volume of the internal cavity in the set of the identical external size can be designed by reducing the area of the opening rim surface of the contacted cavity, thus to improve the value of products.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A microwave sealing structure in an apparatus using microwaves which includes a cavity in which microwaves can resonate having an opening, and a door wherein an equivalent impedance circuit, formed with a rim of the opening and a cross-section of a rim of the door to reduce leakage of microwaves out of the cavity, is a LC resonant circuit, wherein the cross-section of the rim of the door includes:

a door panel portion which is substantially parallel to a surface of the rim of the opening;

a first sealing portion which is substantially perpendicular to the surface of the rim of the opening;

a second sealing portion which is substantially parallel to the surface of the rim of the opening and connected to the first sealing portion in the outward direction of the cavity;

a third sealing portion which is substantially parallel to the first sealing portion connected to the second sealing portion in a direction of the cavity, wherein a distance between the first sealing portion and the third sealing portion is less than 15 mm; and a fourth sealing portion which is substantially parallel to the second sealing portion connected to the third sealing portion, a free end of the fourth sealing portion facing the first sealing portion, wherein the third and fourth sealing portions include a plurality of parts which are positioned in a longitudinal direction of the rim of the door, and wherein the distance between the fourth sealing portion and the second sealing portion is less than 20 mm.

2. The structure of claim 1, wherein the LC resonant circuit includes a first capacitor, an inductance and a second capacitor which are connected with the first capacitor and formed in parallel, and the reactance of the LC resonant circuit is 0.

3. The structure of claim 1, wherein the rim surface of the fourth sealing portion and the opening portion forms a first capacitor, the end of the fourth sealing portion and the first sealing portion form a second capacitor, and the first, second and third sealing portions form an inductance.

4. The structure of claim 1, wherein the width of the third sealing portion is different from the length of the rim of the door in the fourth sealing portion.

5. The structure of claim 1, wherein a plurality of holes for mounting a non-conductive cover which covers the rim of the door, are formed in the third sealing portion.

6. The structure of claim 1, wherein the distance between the fourth sealing portion and the rim surface of the opening is longer than the door panel portion.

7. The structure of claim 6, further comprising a non-conductive cover which is positioned between the fourth sealing portion and the rim surface of the opening, for covering the fourth sealing portion.

8. The structure of claim 1, wherein the reactance of the LC resonant circuit is 0.

9. The structure of claim 1, wherein the LC resonant circuit includes a first capacitor, an inductance and a second capacitor which are connected with the first capacitor and formed in parallel, and the reactance of the LC resonant circuit is 0.

10. The structure of claim 1, wherein the resonant frequency of the LC resonant circuit is a frequency which can be sealed.

11. The structure of claim 1, wherein the resonant frequency of the LC resonant circuit is composed of a plurality of LC resonant circuits having different resonant frequencies.

12. The structure of claim 1, wherein the third sealing portion comprises:

a first part extending from an edge of the second sealing portion;

a plurality of second parts each extending from an edge of the first part to an edge of the fourth sealing portion; and a combining slot formed in each of the plurality of second parts.

13. The structure of claim 1, wherein the third sealing portion comprises:

a first part extending from an edge of the second sealing portion;

a second part extending from an edge of the first part to an edge of the fourth sealing portion; and at least one combining slot formed in a portion of the second part.

14. The structure of claim 13, wherein the first part of the third sealing portion extends continuously along a width of the door.

15. The structure of claim 14, wherein the second part of the third sealing portion comprises a plurality of narrow portions each extending from an edge of the first part of the third sealing portion to an edge of the fourth sealing portion, and wherein a combining slot is formed within each of the plurality narrow portions.

16. The structure of claim 14, wherein the second part of the third sealing portion comprises a plurality of narrow portions each extending from an edge of the first part of the third sealing portion to an edge of the fourth sealing portion with a lateral connecting portion extending between adjacent narrow portions, and wherein a combining slot is formed in each lateral connecting portion.

* * * * *